United States Patent [19]

Bottum

[11] Patent Number: 5,075,967

[45] Date of Patent: Dec. 31, 1991

[54] METHOD OF ASSEMBING A SUCTION ACCUMULATOR

[76] Inventor: Edward W. Bottum, c/o Refrigeration Research, Inc., 525 N. Fifth St., P.O. Box 869, Brighton, Mich. 48116-0869

[21] Appl. No.: 562,336

[22] Filed: Aug. 3, 1990

[51] Int. Cl.[5] ..... F25B 43/00

[52] U.S. Cl. ..... 29/890.06; 29/428; 62/503

[58] Field of Search ..... 29/890.06, 428; 138/30; 62/503

[56] References Cited

U.S. PATENT DOCUMENTS

| | | | |
|---|---|---|---|
| 3,837,177 | 9/1974 | Rockwell et al. | 62/503 |
| 4,488,413 | 12/1984 | Bottum | 62/503 |
| 4,627,247 | 12/1986 | Morse | 62/503 |
| 4,827,725 | 5/1989 | Morse | 62/503 |
| 4,939,904 | 7/1990 | Carlisle, Jr. | 62/503 |

*Primary Examiner*—Irene Cuda

*Attorney, Agent, or Firm*—Bertram F. Claeboe

[57] ABSTRACT

A method of assembling suction accumulators is provided. A suction accumulator as employed in a refrigeration system conventionally comprises a cylindrical casing, a pair of end closures therefor, an inlet tube, an outlet tube, and a stand pipe. In applicant's assembly process, the inlet and outlet tubes are constructed essentially of copper. The assembly method of this invention is practiced by securing the stand pipe with end cap attached to the top end closure, preferably furnace brazing the end closures to the cylindrical casing, inspecting the metering orifice in the end cap of the stand pipe by viewing the same through the open top end of the stand pipe, and inserting the inlet and outlet tubes through openings in the top end closure and brazing them to said closure by induction or furnace brazing techniques. The disclosed assembly method may also be practiced with a heat exchanger—suction accumulator combination.

3 Claims, 2 Drawing Sheets

METHOD OF ASSEMBING A SUCTION ACCUMULATOR

BACKGROUND OF THE INVENTION

It is known in the art to which this invention pertains to provide a suction accumulator between the evaporator and compressor of a refrigeration system in order to protect the compressor from possible damage. Vaporized refrigerant is received from the evaporator and passed on through the suction accumulator to the compressor. Any raw liquid is metered back to the compressor by the accumulator at a rate that will not result in damage to the compressor.

It is also known in the art that without provision of a suction accumulator in the environment just described, compressor failure can be anticipated. This condition is described in some detail in my U.S. Pat. No. 3,837,177, to which reference is now made as to the construction of the suction accumulator disclosed therein. While this version of a straight inner tube within a straight outer tube is an alternative approach, in some cases it constitutes an improvement over the conventional U-tube.

To explain, in the suction accumulator of U.S. Pat. No. 3,837,177, the cylindrical casing, end closures, inlet tube, outlet tube, and stand pipe are conventionally of steel composition. In the assembly thereof, the general practice is to connect all components, except the bottom or end cap, by arc welding or hydrogen brazing techniques. The partially assembled unit is then withdrawn from the process, and inspected to assure that the metering opening will function effectively during operation of the refrigeration system. Following the inspection, the assembly process can be completed by welding or brazing the end closure to the bottom of the unit. Quite clearly, among other disadvantages of this assembly process, the necessity of a further welding step or passage through the brazing furnace a second time represents a cost factor which clearly should be avoided.

SUMMARY OF THE INVENTION

Applicant has discovered that substantial time savings can be effected in the process of assembling suction accumulators, with related improvements in product quality, by utilization in the accumulator structure of inlet and outlet tubes constructed substantially entirely of copper or alloys thereof. The assembly process is markedly simplified in that inspection of the metering orifice in one end of the stand pipe is effectively accomplished after both end closures are brazed to the cylindrical shell. Thereupon, and with no significant break or departure from continuity in the assembly process, the copper inlet and outlet tubes are secured to the top end closure, again preferably utilizing furnace brazing techniques.

In operation of a suction accumulator of the general character herein disclosed, there may on occasion be direct passage of liquid refrigerant droplets between the inlet tube and top of the stand pipe. To preclude this, the stand pipe may be apertured in this region, preferably on the opposite side. Further, it has been found that the provision of an opening at the top of the outlet tube is effective to equalize pressure between the inlet and outlet tubes, thereby preventing refrigerant flooding to the compressor during the "off cycle".

DESCRIPTION OF A PREFERRED EMBODIMENT

Figure 1:
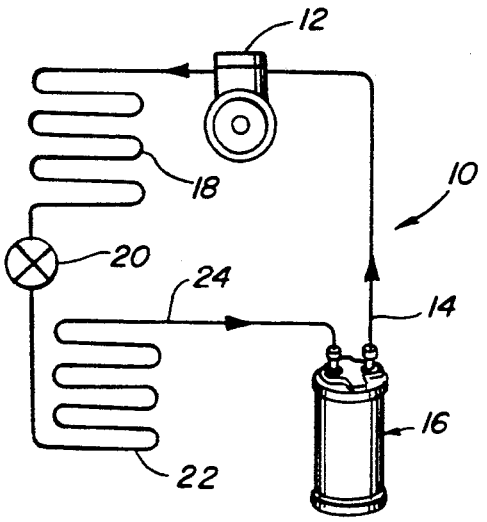
FIG. 1 is a schematic diagram of a refrigeration system embodying a suction accumulator as herein disclosed.

Referring now first to FIG. 1 of the drawings, a conventional refrigeration system 10 is shown, the system being charged with a refrigerant material. As is normal, compressor 12 receives gaseous refrigerant through suction conduit means 14 from suction accumulator 16, the gaseous refrigerant is compressed, and passes to condenser 18. The refrigerant is condensed to a liquid state at 18, and passes through expansion valve 20 whereat its temperature and pressure are reduced. The cooled refrigerant then passes to evaporator 22, wherein it is vaporized by absorbing heat and then enters suction accumulator 16 through conduit means 24.

Figure 2:
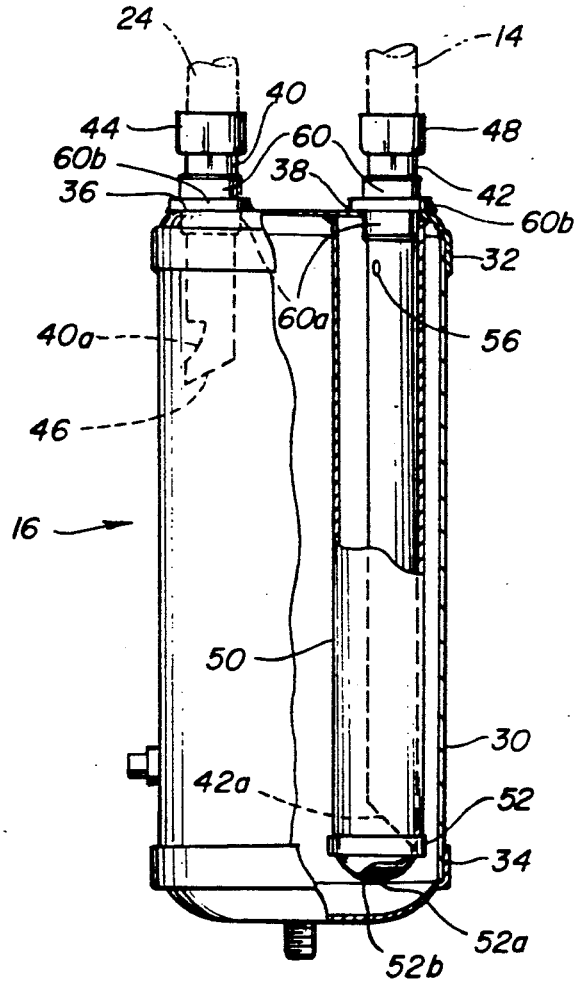
FIG. 2 is a side elevational view taken in section along the line 2—2 of FIG. 3, showing a suction accumulator as produced by the method concept of this invention.
Figure 3:
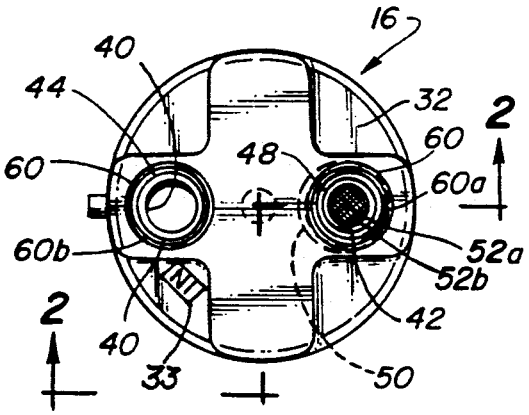
FIG. 3 is a top plan view of the suction accumulator of FIG. 2.

Suction accumulator 16 is shown in detail in FIGS. 2 and 3, and reference is now made thereto. The suction accumulator comprises a generally cylindrical shell or casing 30 to which at opposite ends are brazed cap or closure means 32 and 34. Cap means 32 is apertured at 36 and 38 to receive therethrough inlet tube 40 and outlet tube 42, respectively. A metal tag 33 is secured to cap means 32 to prevent reverse connection of the suction accumulator 16, thereby avoiding damage to the compressor 12.

Figure 4:
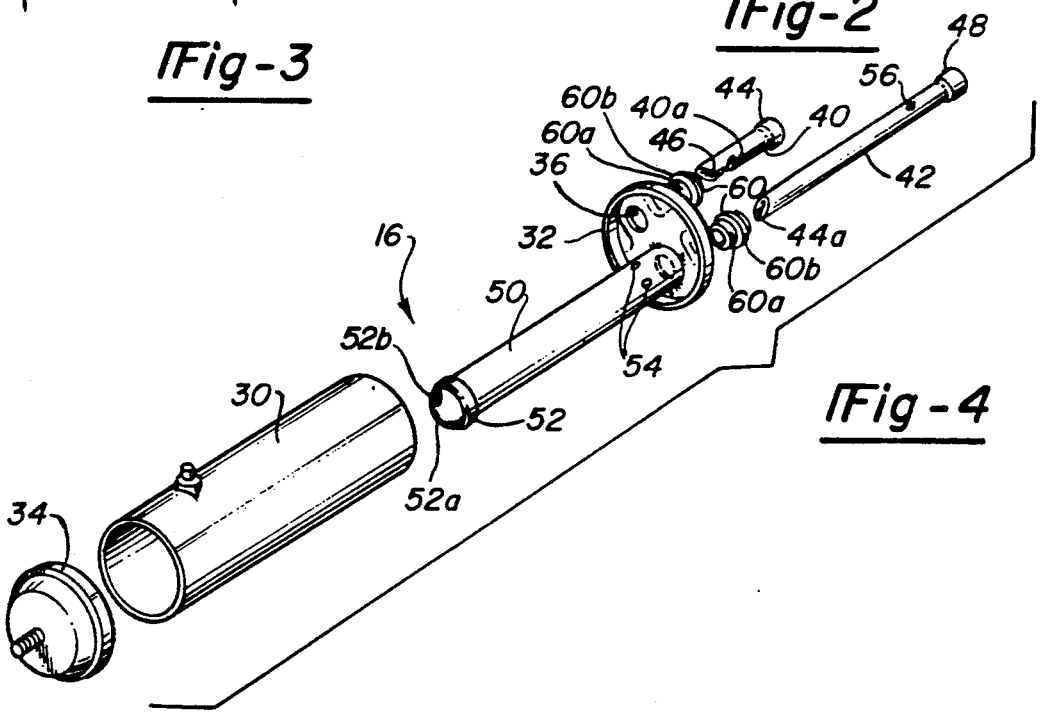
FIG. 4 is an exploded perspective view illustrative of the steps in applicant's assembly method.

Support for the inlet tube 40 and outlet tube 42 within the openings 36 and 38, respectively, are bushing means 60, best shown in FIGS. 2 and 4. The bushing means 60 is formed to include a tubular main body portion **60*a* and integral larger diameter central ring portion 60*b*. During installation, as will be later described, after being seated in the top cap openings 36 and 38, the lower or inner end of each of the bushing means 60** is flared against the inner surface of the top cap or closure to fixedly secure the same thereto.

Copper inlet tube 40 may mount at one end copper nipple means 44, or in the alternative may be expanded, and at its opposite end adjacent the bottom thereof has an opening notch **40*a* forming baffle 46 therein for deflecting gaseous phase change material from inlet tube 40 into shell or casing 30** adjacent the top thereof.

Copper outlet tube 42 may mount at one end copper expanded quill means 48. Opposite end of outlet tube 42 is beveled as at 42*a*. Outlet or inner suction tube 42 is received within stand pipe or outer suction tube 50, and as is shown both FIG. 2 and FIG. 3, outlet tube 42 is of lesser diameter than stand pipe 50. There is thus considerable unoccupied space within the outer tube or stand pipe 50, permitting flow of gaseous material therethrough.

The stand pipe or outer tube 50 is commonly constructed of steel, as are the casing 30 and end closures 32 and 34, and thus in the assembly method may be arc welded to end closure 32 after insertion therethrough. As is shown in FIG. 2, stand pipe or outer tube 50 is provided on the lower end with cap means 52. The cap means is centrally apertured at 52*a* to provide a small metering orifice, and if desired, a small mesh screen 52*b* may be spot welded over the opening 52*a* to prevent the plugging thereof.

Figure 8:
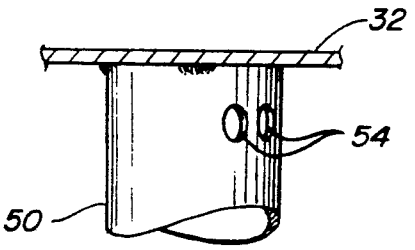
FIG. 8 is a fragmentary side view partially in section, of the upper end of a stand pipe provided with apertures therein.

Stand pipe or outer suction tube 50 at the opposite or upper end thereof may be provided with holes or openings 54 to be later more fully described in connection with FIG. 8. These are effective to direct the passage of refrigerant gas between the inlet tube 40 and upper end of stand pipe 50. With respect to the outlet or inner suction tube 42 at the upper end thereof, a vent opening 56 may be provided to equalize the pressure within the tubes 42 and 50 during the "off cycle".

Applicant's novel process of assembling a suction accumulator, which has among the features thereof employment of inlet and outlet tubes constructed of copper or high copper alloys, advantageously permits an inspection of the stand pipe bottom orifice AFTER both end closures have been brazed to the cylindrical shell in the hydrogen brazing process. As earlier noted, by following the teachings of the present invention, there is essentially no interruption in the assembly process, and a time consuming welding step is eliminated.

A further important advantage of the assembly method herein disclosed is the marked improvement in making connections to the inlet and outlet tubes. By the prior art, when the inlet and outlet tubes are of steel composition, to effect a joinder thereto of copper tubing requires a silver solder and flux. This is time-consuming to perform, requires flux removal, and leaks at the joint are not infrequent.

In contrast thereto, applicant has found that by provision of inlet and outlet tubes fabricated from copper or high copper alloys, copper tubular connections thereto can be effectively made using as the braze metal a phos-copper alloy constituted generally of about 15% silver, 5% phosphorus and 80% copper. No flux is required, the brazing alloy is much less costly, and a tight joint is obtained in minimum time.

In practice of applicant's method of assembly of a suction accumulator, it is to be understood that the basic components of this particular refrigerant vessel are a cylindrical shell or casing, end closures therefor, a stand pipe or outer suction tube, an outlet tube or inner suction tube, and an inlet tube. Accordingly, in practice of the present process concept, and as is best shown in FIG. 4, the preferred steps are as follows:

1. The bushing means 60 are inserted in each of the top cap openings 36 and 38, and the inner ends thereof flared against the underside of the top cap 32. The bushings, formed of steel, are then hydrogen copper brazed to the steel top cap in a hydrogen copper brazing furnace.
2. The stand pipe 50 with end cap 52 secured thereto is arc welded to the top end closure 32 on the underside thereof.
3. The end closures 32 and 34 are secured to the cylindrical shell 30 in a hydrogen brazing furnace using copper as the brazing metal, or by arc welding the end closures to the shell.
4. Inspect the stand pipe metering orifice 52 to make certain it is open, by viewing through the top of the stand pipe 50.
5. Insert the copper inlet and outlet tubes 40 and 42, into the bushing means 60 secured in the top end closure 32. Immediately prior thereto, a silver ring is positioned upon the upper end of each bushing means 60. With the parts as thus located in place, the inlet and outlet tubes 40 and 42 are induction welded to their respective bushings 60.
6. The assembly is pressure tested.

Figure 9:
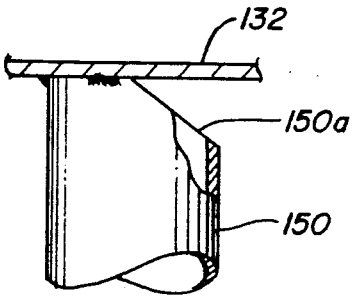
FIG. 9 is a view similar to FIG. 8, and illustrating a modified form of stand pipe structure.

With reference now to certain structural details of the stand pipe 50, it was earlier noted that holes or openings 54 may be provided therein at the upper end thereof in order to direct the passage of liquid refrigerant between the inlet tube 40 and upper end of the stand pipe 50. This is shown more fully in the detail view of FIG. 8. As an alternative thereto, and as shown in FIG. 9, stand pipe 150 secured to top cap 132 may be formed to include a bias surface 150*a*.

Figure 5:
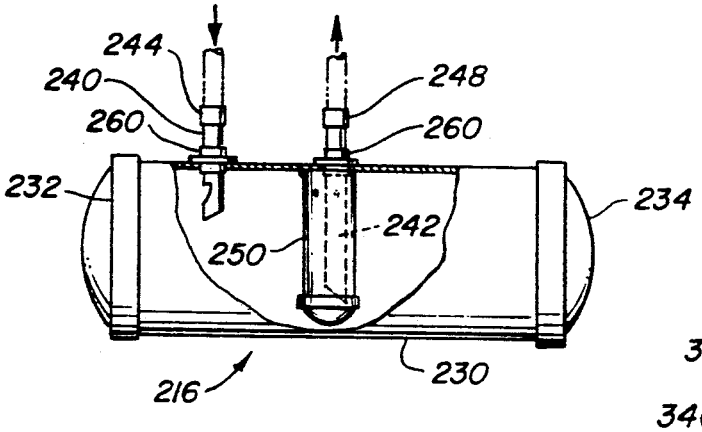
FIG. 5 is a side view of a suction accumulator constructed for employment in a horizontal position.

The suction accumulator 16 best shown in FIGS. 1 and 2 has been described as vertically positioned. However, particular conditions may dictate that the suction accumulator be constructed and arranged for horizontal positioning. This is shown in FIG. 5, to which like numerals corresponding to like parts shown in FIGS. 1 and 2 have been applied, raised by the numerals "200".

Figure 6:
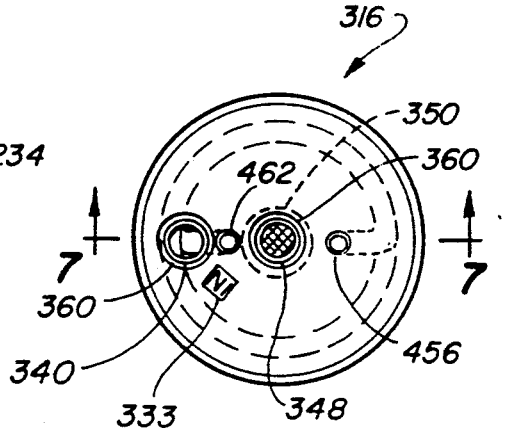
FIG. 6 is a top plan view of the structure of FIG. 7.
Figure 7:
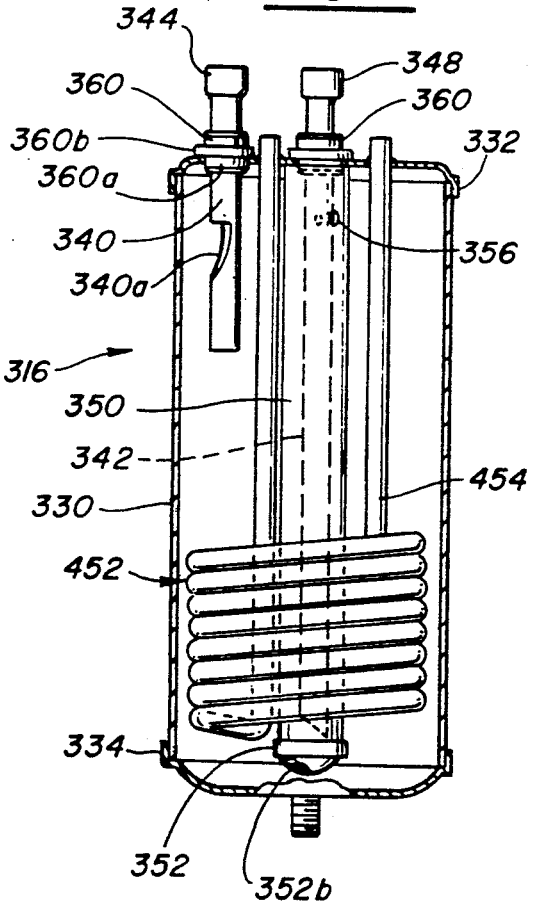
FIG. 7 is a side elevational view taken in section along the line 7—7 of FIG. 6, and showing a modified form of heat exchanger—suction accumulator assembled by the method of this invention.

It is also within the purview of this invention to employ a heat exchanger in association with a suction accumulator substantially as shown and described in the earlier views of the drawings. This is shown in FIGS. 6 and 7, and in this regard, reference is made to my earlier U.S. Pat. No. 4,488,413 issued Dec. 18, 1984. The heat exchanger shown therein is well-adapted to the present invention.

Since the suction accumulator of FIGS. 6 and 7 substantially corresponds to the form of the invention shown primarily in FIGS. 1 and 2, like numerals from the latter two views have been applied to like parts in FIGS. 6 and 7, raised by the numerals "300". As appears in these two views, particularly with respect to the heat exchanger portion thereof, a hollow coil 452 is spirally positioned within the casing or shell 330, but outside the larger diameter tube or stand pipe 350. Upper end 454 of the coil 452 is passed out of the shell 330 through top cap opening 456, and preferably is brazed to top cap or closure 352 of the suction accumulator 316.

Lower end 460 of the hollow coil 452 extends out of opening 462 in top cap 332. The mode of combined operation of a suction accumulator and heat exchanger is well-described in U.S. Pat. No. 4,488,413, and all material pertinent thereto is incorporated herein by reference.

It is now believed apparent to those skilled in the art that applicant's novel method of assembling a suction accumulator earlier described in connection with FIGS. 2 and 3 can readily be practiced with the form of the invention shown in FIGS. 6 and 7. Referring now back to the four tabulated steps in the present assembly method, the heat exchanger coil 452 appearing in FIGS.

6 and 7 is positioned within the shell or casing 330 intermediate Steps 1 and 2, that is, after securement of the stand pipe 350 to end cap 352. Thereafter, intermediate Steps 3 and 4, the upper end 454 of coil 452 is passed through opening 456, and brazed in place. Similarly, lower end 466 of coil 452 is passed through opening 462 within top cap 352, and also brazed in place. The assembly method advantages earlier noted in connection with FIGS. 2 and 3 apply equally well to the structure of FIGS. 6 and 7.

Various changes and modifications to the present invention have been set forth herein, and these and other variations may of course be practiced without departing from the spirit of the invention or the scope of the subjoined claims.

I claim:

1. In a method of assembling a suction accumulator comprised of a tubular steel casing, steel end closures for said casing, one of said end closures being provided with openings therein, an inlet tube, an outlet tube, and a steel stand pipe mounting at one end cap means having a metering orifice therein, the method comprising the steps of securing steel bushing means to said one end closure through the openings therein, securing the stand pipe to the underside of said one end closure, securing said steel end closures to opposite ends of said steel casing, inspecting the metering orifice in said stand pipe cap means by viewing the same through the opposite end of said stand pipe, constructing said inlet tube and said outlet tube of copper, and securing said copper inlet tube and said copper outlet tube to said steel bushing means.

2. A method of assembling a suction accumulator as defined in claim 1, in which the bushing means are flared to the underside of said one end closure and are then hydrogen copper brazed thereto.

3. A method of assembling a suction accumulator as defined in claim 1, in which the bushing means are secured to said one end closure by hydrogen copper brazing, in which the stand pipe is secured to the underside of said one end closure by welding, in which the end closures are secured to opposite ends of said casing by hydrogen copper brazing, and in which the copper inlet and outlet tubes are secured to said steel bushing means by induction welding.

* * * * *